US005864974A

United States Patent [19]

Dahlquist

[11] Patent Number: 5,864,974

[45] Date of Patent: Feb. 2, 1999

[54] INTEGRAL ERECTABLE DISPLAY UNIT

[75] Inventor: Ake L. Dahlquist, Dixon, Ill.

[73] Assignee: Dixonweb Printing Company, Dixon, Ill.

[21] Appl. No.: 781,339

[22] Filed: Jan. 10, 1997

[51] Int. Cl.[6] ..... G09F 1/00

[52] U.S. Cl. ..... 40/124.16; 40/539

[58] Field of Search ..... 40/124.16, 124.09, 40/539, 610, 750, 751

[56] References Cited

U.S. PATENT DOCUMENTS

| | | |
|---|---|---|
| 2,125,424 | 8/1938 | Cloud . |
| 2,142,826 | 1/1939 | Rosello . |
| 2,311,218 | 2/1943 | Fandrich . |
| 2,449,911 | 9/1948 | Roth . |
| 2,472,166 | 6/1949 | Mathewson . |
| 2,530,950 | 11/1950 | Ebert et al. . |
| 2,720,046 | 10/1955 | Decker . |
| 2,975,905 | 3/1961 | Foland . |
| 3,029,051 | 4/1962 | Nichols . |
| 3,226,863 | 1/1966 | Southard . |
| 3,763,583 | 10/1973 | Gregg . |
| 5,037,099 | 8/1991 | Burtch . |
| 5,259,133 | 11/1993 | Burtch . |
| 5,287,641 | 2/1994 | Showers . |
| 5,361,521 | 11/1994 | Burtch . |
| 5,465,961 | 11/1995 | Burtch . |
| 5,479,732 | 1/1996 | Burtch et al. . |
| 5,608,977 | 3/1997 | Burtch et al. ..... 40/610 X |
| 5,613,311 | 3/1997 | Burtch ..... 40/610 X |

FOREIGN PATENT DOCUMENTS

| | | |
|---|---|---|
| 162551 | 5/1921 | United Kingdom . |
| 881755 | 11/1961 | United Kingdom . |

*Primary Examiner*—Brian K. Green
*Attorney, Agent, or Firm*—Ryndak & Lyerla

[57] ABSTRACT

An integral, erectable display unit is movable between a flat position and an erected position. The display unit includes a first panel, having a display portion and a base, and five additional panels. The second panel is attached to the sixth panel to complete assembly of the display unit. In the flat position, the display portion is covered by the third and sixth panels on one side and the fourth and fifth panels on the other side. The display unit is placed in the erected position by passing the display portion through an aperture defined by the third and fourth panels.

12 Claims, 2 Drawing Sheets

INTEGRAL ERECTABLE DISPLAY UNIT

BACKGROUND OF THE INVENTION

1. Field of the Invention

The invention relates generally to an integral erectable display unit, and more particularly, to such a display unit that can be erected from a flat, card-like mode to a three-dimensional, erected mode.

2. Description of the Related Art

In recent years, display units that are movable between an essentially two-dimensional, flat, card-like position and a three-dimensional erected position have become increasingly popular. In the two-dimensional position, these units often include panels that display information about an individual or a character. In the erected position, a display portion having a two-dimensional depiction of an individual may rise through an opening in the panels, which then become a base portion of the display unit. When the display unit is in its card-like position the individual depiction may be covered by the information-bearing panels.

One such display device is disclosed in U.S. Pat. No. 5,479,732 to Burtch et al. As shown in FIG. 1 therein, an erectable periscoping display device includes a display panel, four intermediate panels and an end panel. The display panel includes an elongated tongue portion and a base portion. The two central intermediate panels define a slot through which the elongated tongue portion passes to place the display device in its erected configuration. The end panel is glued to the base portion of the display panel to complete construction of the display device. Proper alignment of the relatively short end panel and base portion can be a difficult process. A slight misalignment can cause the lower portion of the display device to be lopsided rather than flat when the device is in its erected position. Misalignment of the end panel and the base portion also can prevent proper functioning of the display device in its planar configuration. Such difficulties can lead to waste which is a problem especially where the display devices are given away as promotional items free of charge. Moreover, the process involved in making a display device of this design does not easily lend itself to cost effective production in large quantities. The end panel must be folded back against the adjacent panel and held in that position for gluing to the base portion of the display panel. This display device is typically manually assembled, which can further increase the opportunity for problems. Manual assembly of these display devices can be a slow and tedious process that demands near perfection to avoid the aforementioned problems.

Thus, it would be desirable to have an integral, erectable display unit that would not require intricate alignment of its attached surfaces in order to have its lower portion lie flat when the display device is in its erected position. It also would be desirable to have such a device designed in such a way that it can be manufactured by the application of processing system(s) having high output capability. The unique design of the present invention advantageously lowers the per unit cost of manufacturing display units.

SUMMARY OF THE INVENTION

An integral, erectable display unit in accordance with the present invention reduces or eliminates the aforementioned problems. The display unit is convertible between a flat position and an erected position. The display unit includes an erectable first panel having a display portion and a base. The display unit also includes five additional panels. The second panel is adjacent the base of the first panel. The third, fourth, fifth and sixth panels are each adjacent the respective, preceding panel. The panels are defined by first, second and third fold lines and first and second score lines. The sixth panel is attached to the second panel. For example, adhesive can be used to attach the sixth panel to the second panel. The third and fourth panels together define an aperture along the second fold line through which the erectable first panel extends when the display unit is moved from the flat position into the erected position. The base of the first panel can be wider than the display portion, which, in turn, can be wider than the aperture. The second panel and the sixth panel preferably have substantially equal lengths. No intricate alignment is required for the bottom of the display unit (i.e., the fifth and sixth panels) to lie flat when the display unit is in the erected position on a flat surface. Thus, it is less likely that waste will occur in the form of non-functional display units.

A blank in accordance with the present invention is foldable into an integral, erectable display unit that is convertible between a flat position and an erected position. The blank generally includes six adjacent panels. The erectable first panel has a display portion and a base. The remaining panels are defined by first, second and third fold lines and first and second score lines. The second panel and the sixth panel have substantially equal lengths. The third and fourth panels together can define an aperture along the second fold line through which the erectable first panel extends when the blank is folded into a display unit and the display unit is in the erected position.

The present invention also includes a method for making the integral, erectable display unit. The method uses a blank that initially can be printed on part or all of one or both sides. A dryer can be used to dry the ink after printing, if necessary. The blank has six contiguous panels arranged linearly, the first panel having a display portion on its free end and a base adjacent the second panel. The first panel is folded along a first fold line to overlie the second panel. Then, the fourth panel, together with the fifth and sixth panel, is folded along a second fold line such that the fourth panel overlies the third panel. Adjacent portions of the third panel and the fourth panel are cut away to define an aperture therebetween. The aperture can be made by a die cutting process. The sixth panel is then folded along a third fold line and attached to the second panel.

The preferred method for manufacturing integral, erectable display units begins by printing both sides of a web and drying the ink. Next, the web is contour die cut to define a plurality of display portions along one edge of the web and/or individual ribbons. The web may be scored with five parallel lines including first, second and third fold lines and first and second score lines. The lines define a plurality of sets of six panels. Each set of six panels defines a display unit. The first panel in each set includes a display portion and an adjacent base wider than the display portion. The second, third, fourth, fifth and sixth panels of each set extend transversely across the web from the first panel. The web is folded along the first fold line such that the first panels overlie the second panels. Then the web is folded along the second fold line such that the fourth panels overlie the third panels. Adjacent portions of the third panels and the fourth panels are die cut and the double layer chip removed to define an aperture between each third panel and fourth panel. Adhesive is applied to the second and/or sixth panels. The sixth panel is folded along the third fold line and attached to the second panel. Finally, the web (or ribbons) is separated into a plurality of display units. This method lends itself to semi-automatic mass production, which is more cost effective than existing methods. The semi-automatic mass production also reduces the likelihood that manufacturing errors will occur due to, e.g., human error.

DETAILED DESCRIPTION OF THE PREFERRED EMBODIMENT

Figure 1:
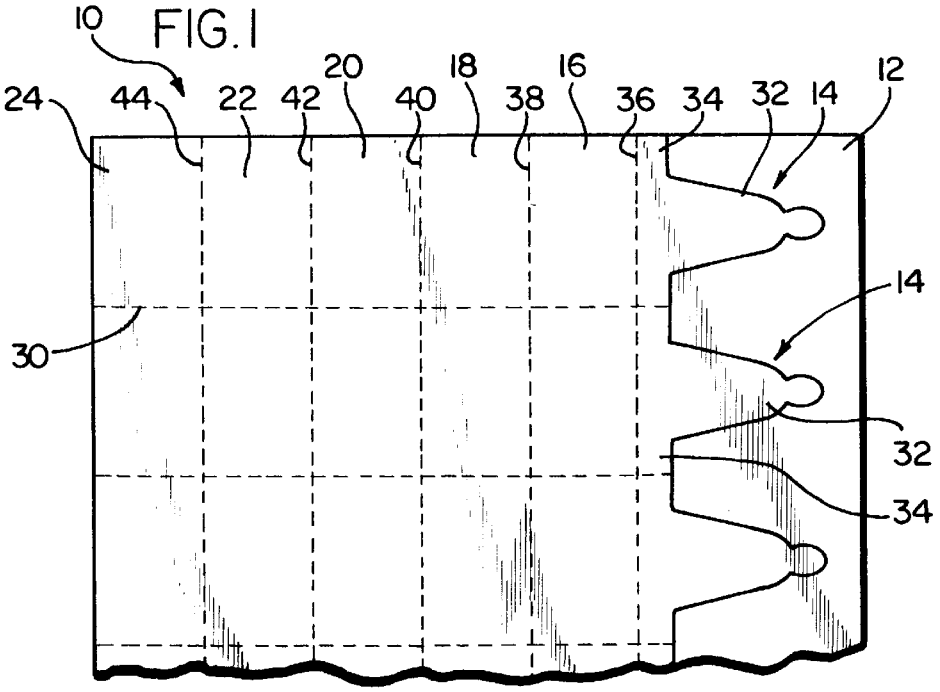
FIG. 1 is a top plan view of a portion of a web or ribbon for use in making integral, erectable display units in accordance with the present invention.

Referring first to FIG. 1, there is shown a web or a ribbon 10 that is used in manufacturing an integral, erectable display unit in accordance with the present invention. Web 10 can be paper. Only a small length of web 10 is shown in FIG. 1. In practice, web 10 preferably is fed through printing presses and manufactured from a continuous web unwinding from a roll. Web 10 can be printed with information and/or pictures on one or both sides using, e.g., web offset, heat-set printing. Preferably, at least a portion of web 10 is printed on both sides. After printing, web 10 can be passed through a dryer. Web 10 is then contour die cut and scored. The contour die cut process removes excess material 12 depicted in FIG. 1.

Figure 5:
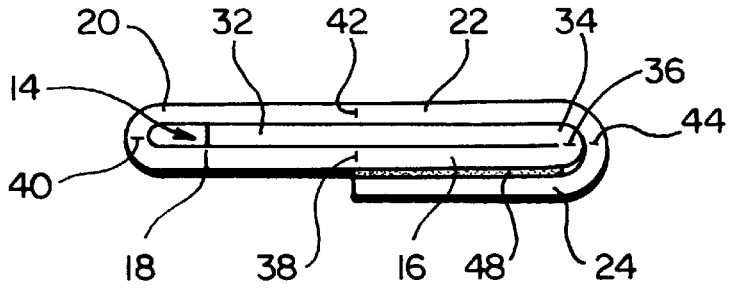
FIG. 5 is a side elevation of the integral, erectable display unit of the present invention in its flat position.
Figure 6:
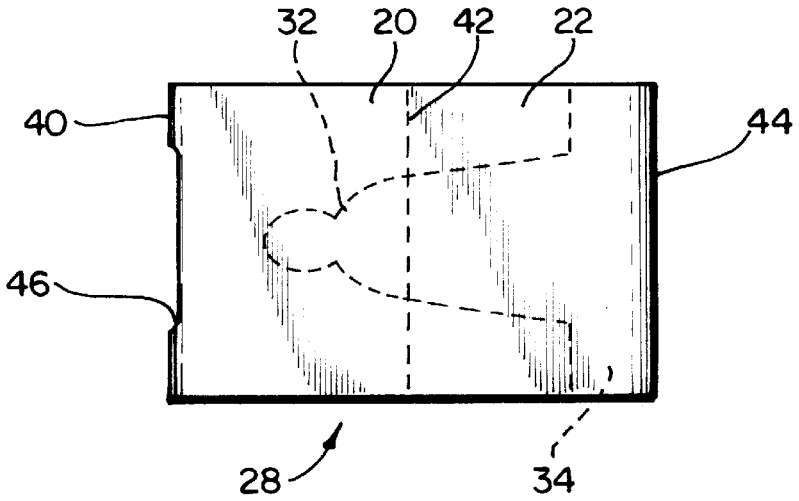
FIG. 6 is a top plan view of the display unit of FIG. 5 in its flat position showing a first panel thereof in phantom.
Figure 7:
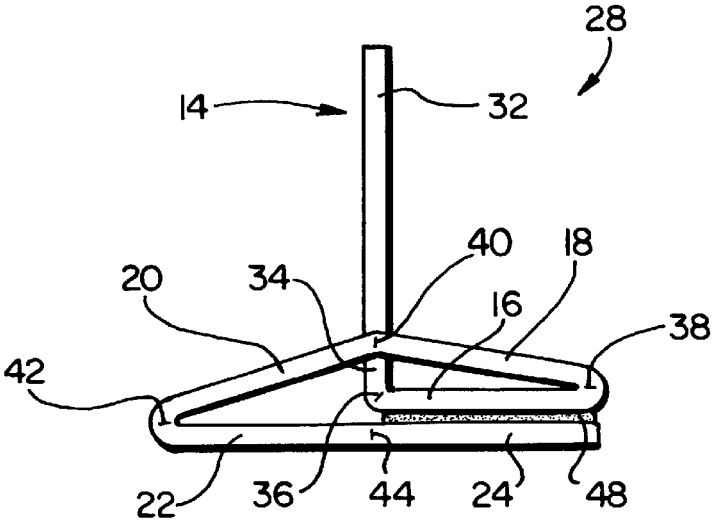
FIG. 7 is a side elevation of the display unit of FIG. 5 in its erected position.

Web 10 generally includes a plurality of first panels 14, second panels 16, third panels 18, fourth panels 20, fifth panels 22 and sixth panels 24. Each set of six panels together defines what will become a single display unit 28 as shown in FIGS. 5–7.

As shown in FIG. 1, each of panels 16, 18, 20, 22 and 24 is adjacent and integral with the preceding panel. The adjacent panels are defined by either a fold line or a score line. Each first panel 14 includes a display portion 32 and a base 34. Display portion 32 is defined by the removal of excess material 12. Display portion 32 may be in the shape of an individual or a character and may have a picture or photograph printed thereon. Base 34 is adjacent second panel 16, but is separated therefrom by a first fold line 36. Second panel 16 is adjacent third panel 18, but is dimensionally separated therefrom by a first score line 38. A second fold line 40 separates third panel 18 from fourth panel 20. Fourth panel 20 and fifth panel 22 are dimensionally separated by a second score line 42. Finally, a third fold line 44 separates fifth panel 22 from sixth panel 24. First fold line 36, second fold line 40 and third fold line 44 are visibly depicted on web 10 (ie., are shown scored on web 10) in FIG. 1. However, in practice, fold lines 36, 40 and 44 may or may not be scored on web 10.

Figure 2:
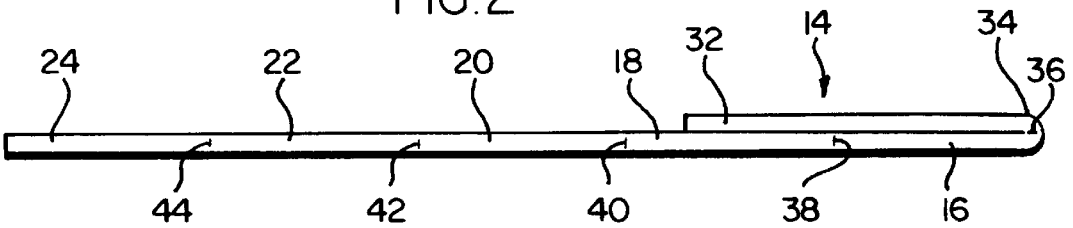
FIG. 2 is a side elevation of a blank being folded to make the integral, erectable display unit of the present invention.
Figure 3:
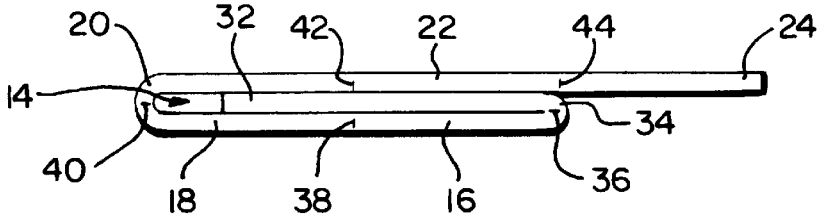
FIG. 3 is a side elevation of the blank of FIG. 2 at a later point in the manufacturing process than shown in FIG. 2.
Figure 4:
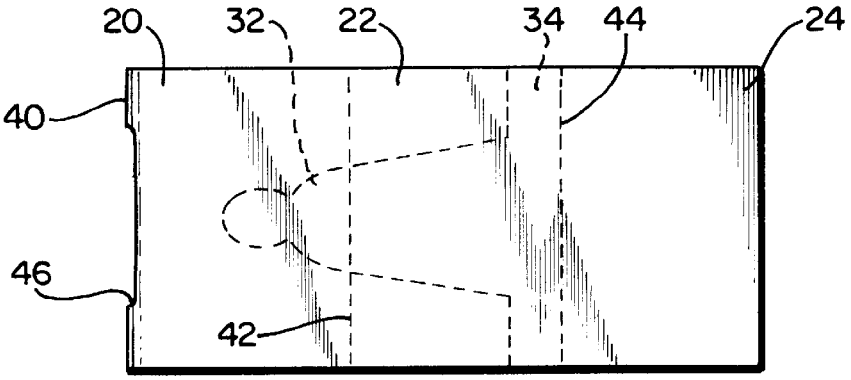
FIG. 4 is a top plan view of the blank of FIG. 2 at a later point in the manufacturing process than shown in FIG. 2.

After web 10 has reached the state shown in FIG. 1 (and excess material 12 has been removed), the automated folding process begins. As shown in FIG. 2, the first step in the folding process is to fold first panel 14 along fold line 36 so that first panel 14 overlies second panel 16. First panel 14 typically is long enough that it also overlies a portion of third panel 18. For ease of illustration, the panels in FIG. 2 are drawn proportionately thicker than they would be in an actual display device. Next, as shown in FIG. 3, fourth panel 20 is folded along second fold line 40 to overlie third panel 18. An aperture 46 preferably is then die cut through adjacent portions of third panel 18 and fourth panel 20 along second fold line 40. FIG. 4 is a top plan view of an individual display unit substantially as it would appear at this stage of manufacture. Aperture 46 alternatively can be die cut at an earlier, or even a later, point in the manufacturing process. Display unit 28 also can be provided with a pair of slits (not shown) extending outwardly from aperture 46 along fold line 40. FIG. 4 shows display portion 32 and base 34 in phantom. At this point in the manufacturing process, sixth panel 24 extends beyond the juncture of base 34 and second panel 16 at first fold line 36.

Display portion 32 is wider than aperture 46 for reasons that are explained below. Adhesive 48 or other suitable means is placed on second panel 16 and/or sixth panel 24. Sixth panel 24 can be attached to second panel 16 using, e.g., glue, tape, a hook and loop fastener or through a cooperation of sixth panel 24 and second panel 16 such as, e.g., having a slot and tongue arrangement in which one panel has a tongue and the other has a complementary slot to accept the tongue. Referring now to FIG. 5, sixth panel 24 is folded about third fold line 44 and attached to second panel 16. Sixth panel 24 and second panel 16 preferably have substantially the same length so that fifth panel 22 and sixth panel 24 can lie flat when display unit 28 is in the erected position of FIG. 7. Thus, sixth panel 24 preferably extends to first score line 38.

FIG. 6 depicts a finished display unit 28 in its flat position. FIG. 6 depicts display portion 32 and base 34 in phantom. In the preferred embodiment, display portion 32 is not visible when display unit 28 is in its flat position. Rather, display portion 32 is covered by fourth panel 20 and fifth panel 22 on one side and third panel 18 and sixth panel 24 on the other side.

Display unit 28 is depicted in the erected position in FIG. 7. Display portion 32 passes through aperture 46 and is visible over third panel 18 and fourth panel 20. Second panel 16 and third panel 18 bend outwardly at first score line 38 when display unit 28 is moved from the flat position of FIG. 6 to the erected position of FIG. 7. Similarly, fourth panel 20 and fifth panel 22 bend outwardly at second score line 42. As display portion 32 is wider than aperture 46, display portion 32 is wedged in between the sides of aperture 46 as defined by third panel 18 and fourth panel 20. This wedge effect maintains display portion 32 in the erected position. In the embodiment having a pair of slits extending outwardly from aperture 46, display portion 32 is wide enough to extend into the slits. Fifth panel 22 and sixth panel 24 form a flat, stable bottom to display unit 28. Even if sixth panel 24 is not perfectly aligned with second panel 16, the bottom of display unit 28 will be flat when display unit 28 is placed on a flat surface in the erected position because fifth panel 22 and sixth panel 24 form a planar surface.

Display unit 28 can have virtually any desired height and width required for a given application. The height of first panel 14 is limited by the overall height of display unit 28. Also, in the preferred embodiment, the height of first panel 14 is limited by the size of aperture 46 where aperture 46 is die cut after fourth panel 20 is folded over third panel 18.

Thus, the present invention provides an integral, erectable display unit that does not require intricate alignment of its surfaces in order to have the bottom lie flat when the display unit is in its erected position. The display unit also can be manufactured by automated machinery rather than manually. The display unit of the present invention also can be assembled manually. Even assembled manually, the display unit reduces or eliminates the problems associated with prior art display units by making it easier to ensure that the bottom of the display unit is flat in the erected position and that the display unit is not lopsided.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. An integral, erectable display unit convertible between a flat mode and an erected mode, comprising:

an erectable first panel having a display portion and a base;

a second panel adjacent said base of said first panel and joined to said first panel along a first fold line, said second panel having a surface;

a third panel adjacent said second panel and joined to said second panel along a first score line;

a fourth panel adjacent said third panel and joined to said third panel along a second fold line;

a fifth panel adjacent said fourth panel and joined to said fourth panel along a second score line; and a sixth panel adjacent said fifth panel and joined to said fifth panel along a third fold line, said sixth panel having a surface at least a portion of which is directly attached to at least a portion of the surface of said second panel;

wherein said third and fourth panels together define an aperture along said second fold line through which said erectable first panel extends when the display unit is moved from the flat mode into the erected mode.

2. The display unit of claim 1 wherein at least a portion of said display portion is wider than said aperture.

3. The display unit of claim 1 wherein said base is wider than said display portion.

4. The display unit of claim 1 wherein said second panel and said sixth panel have substantially equal lengths.

5. The display unit of claim 4 wherein said fifth panel and said sixth panel lie flat when the display unit is in the erected mode on a flat surface.

6. The display unit of claim 1 further comprising adhesive for attaching said surface of said sixth panel to said surface of said second panel.

7. An integral, erectable display unit convertible between a flat mode and an erected mode, comprising:

an erectable first panel having a display portion and a base;

a second panel having a surface and being adjacent said base of said first panel and joined to said first panel along a first fold line;

a third panel adjacent said second panel and joined to said second panel along a first score line;

a fourth panel adjacent said third panel and joined to said third panel along a second fold line;

a fifth panel adjacent said fourth panel and joined to said fourth panel along a second score line;

a sixth panel having a surface and being adjacent said fifth panel and joined to said fifth panel along a third fold line; and means for directly attaching at least a portion of the surface of said sixth panel to at least a portion of the surface of said second panel;

wherein said third and fourth panels together define an aperture along said second fold line through which said erectable first panel extends when the display unit is moved from the flat mode into the erected mode.

8. The display unit of claim 7 wherein at least a portion of said display portion is wider than said aperture.

9. The display unit of claim 7 wherein said base is wider than said display portion.

10. The display unit of claim 7 wherein said second panel and said sixth panel have substantially equal lengths.

11. The display unit of claim 10 wherein said fifth panel and said sixth panel lie flat when the display unit is in the erected mode on a flat surface.

12. The display unit of claim 7 wherein said attaching means comprises adhesive.

* * * * *